US009091982B2

(12) United States Patent
Sugiyama et al.

(10) Patent No.: US 9,091,982 B2
(45) Date of Patent: Jul. 28, 2015

(54) FIXING PRESSURE ROLLER

(71) Applicants: NOK CORPORATION, Tokyo (JP); SYNZTEC CO., LTD, Tokyo (JP)

(72) Inventors: Shingo Sugiyama, Kanagawa (JP); Junichi Nakayama, Kanagawa (JP); Wataru Nemoto, Kanagawa (JP); Atsushi Ikeda, Kanagawa (JP)

(73) Assignees: NOK CORPORATION, Tokyo (JP); SYNZTEC CO., LTD., Tokyo (JP)

( * ) Notice: Subject to any disclaimer, the term of this patent is extended or adjusted under 35 U.S.C. 154(b) by 94 days.

(21) Appl. No.: 13/869,552

(22) Filed: Apr. 24, 2013

(65) Prior Publication Data

US 2013/0287461 A1 Oct. 31, 2013

(30) Foreign Application Priority Data

Apr. 27, 2012 (JP) ..... 2012-104170

(51) Int. Cl.
*G03G 15/20* (2006.01)

(52) U.S. Cl.
CPC ..... *G03G 15/2089* (2013.01); *G03G 15/206* (2013.01); *G03G 2215/2025* (2013.01); *G03G 2215/2035* (2013.01)

(58) Field of Classification Search
CPC ..... G03G 15/206; G03G 15/2053; G03G 2215/2025; G03G 2215/2035; G03G 15/2089
USPC ..... 399/330, 333
See application file for complete search history.

(56) References Cited

U.S. PATENT DOCUMENTS

2010/0104335 A1* 4/2010 Kamimura et al. ..... 399/333

FOREIGN PATENT DOCUMENTS

| | | |
|---|---|---|
| CN | 1831675 | 9/2006 |
| JP | 4638714 | 12/2010 |

OTHER PUBLICATIONS

Chinese Office Action, dated Mar. 9, 2015, in corresponding Chinese Patent Application No. 201310149206.6.

* cited by examiner

*Primary Examiner* — Hoang Ngo
(74) *Attorney, Agent, or Firm* — Young & Thompson

(57) ABSTRACT

The invention provides a fixing pressure roller having an elastic layer formed of a porous material produced from an emulsion, the roller having improved durability. The fixing pressure roller has a core, a rubber layer which has a thickness of 1.0 mm or less and which is provided around the core, and an elastic layer which is formed of a porous elastomer produced from an emulsion composition and which is provided around the rubber layer, the emulsion composition having a continuous phase of a liquid rubber material which forms an elastomer through curing.

19 Claims, 5 Drawing Sheets

FIXING PRESSURE ROLLER

The entire disclosure of Japanese Patent Application No. 2012-104170 filed on Apr. 27, 2012 is expressly incorporated by reference herein.

BACKGROUND OF THE INVENTION

1. Field of the Invention

The present invention relates to a pressure-applying fixing roller (hereinafter referred to as a "fixing pressure roller") having an elastic layer formed of a porous elastomer such as a silicone porous elastomer, which fixing roller is suitably employed as a fixation roller, a pressure roller, or the like of a fixation unit.

2. Background Art

In electrophotographic image-forming apparatuses such as a printer and a copying machine, rollers such as a fixing roller and a pressure roller are employed in an image fixation unit for fixing an unfixed toner image. In operation, the fixing roller and the pressure roller in an image fixation unit are rotated at high temperature while the rollers are pressed to provide a nip portion. In order to reduce the energy required for heating the fixing pressure rollers, the heat capacity of the rollers must be reduced. One known means for this is employment of a porous member.

Conventionally, an elastic layer formed of silicone rubber foam produced by use of a foaming agent is employed. In such silicon rubber foam, the cell size and thickness of intercellular portion tend to vary, resulting in cell breakage at stress concentration when the rubber foam is compressed. In this case, the pressure of the nip portion lowers, causing unfavorable fixation failure.

Under such circumstances, a porous elastomer having spherical cells of a uniform size has become a promising material. The porous elastomer is produced from an emulsion composition having a continuous phase formed of a liquid rubber material which provides an elastomer through curing (see, for example, Patent Document 1).

However, when such a porous elastomer is bonded to a core metal shaft by use of a silane coupling agent, and the produced member is employed as an elastic layer of a fixing roller or a pressure roller in the fixation unit, a portion of the elastic layer in the vicinity of the core metal shaft is broken due to shear stress upon pressure application. In this case, transmission means such as driving force is problematically lost.

Patent Document 1: Japanese Patent No. 4638714

SUMMARY OF THE INVENTION

In view of the foregoing, an object of the present invention is to provide a fixing pressure roller having an elastic layer formed of a porous material produced from an emulsion, the roller having improved durability.

In a first mode of the present invention for attaining the aforementioned object, there is provided a fixing pressure roller comprising:

a core, a rubber layer which has a thickness of 1.0 mm or less and which is provided around the core, and an elastic layer which is formed of a porous elastomer produced from an emulsion composition and which is provided around the rubber layer, the emulsion composition having a continuous phase of a liquid rubber material which forms an elastomer through curing.

A second mode of the present invention is drawn to a specific embodiment of the fixing pressure roller according to the first mode, wherein the liquid rubber material is a liquid silicone rubber.

A third mode of the present invention is drawn to a specific embodiment of the fixing pressure roller according to the first or second mode, wherein the emulsion composition comprises a W/O-type emulsion.

The present invention enables provision of a fixing pressure roller having an elastic layer formed of a high-durability porous elastomer having substantially spherical microcells, whereby delamination or breakage in the vicinity of the core can be prevented.

BRIEF DESCRIPTION OF THE DRAWINGS

Various other objects, features, and many of the attendant advantages of the present invention will be readily appreciated as the same becomes better understood with reference to the following detailed description of the preferred embodiments when considered in connection with the accompanying drawings, in which.

DETAILED DESCRIPTION OF PREFERRED EMBODIMENTS

The porous elastomer employed in the present invention is formed of an elastomeric matrix, and numerous microcells which are uniformly dispersed in the matrix and which are substantially in the form of complete spheres.

Examples of the elastomer forming the matrix include silicone, urethane, chloroprene, ethylene-propylene copolymer (EPM), ethylene-propylene-diene terpolymer (EPDM), styrene rubber (SBR), nitrile rubber (NBR), polyester elastomer, polyether elastomer, polyolefin elastomer, and epichlorohydrin rubber. Among them, silicone rubber is preferred from the viewpoints of heat resistance and other properties of the fixing pressure roller.

The porous elastomer employed in the present invention is produced from an emulsion composition having a continuous phase of a liquid rubber material which forms an elastomer. More specifically, the porous elastomer of the present invention is produced by curing the liquid rubber material, serving as the continuous phase of the emulsion composition, while the emulsion state is maintained, to thereby form an elastomeric matrix, and then removing the dispersion phase, to thereby form cells. The cells are in the form of complete spheres and virtually separated from one another.

The elastomer composition employed in the present invention has a large number of very minute microcells at high density. Therefore, differing from conventional porous materials produced by use of a chemical forming agent and having an equivalent porosity, the elastomer composition of the invention has considerably many cells per unit area. The porosity of the porous elastomer of the present invention is, for example, 30% or higher, preferably 40% or higher, and the number of cells per unit area (1 $mm^2$) is 200 or more, preferably 1,000 or more, more preferably 2,000 or more.

As described above, the porous elastomer of the present invention is formed from an emulsion composition. More specifically, by removing the cells generated by foam involved in the emulsion composition, a porous elastomer having only substantially spherical cells can be provided. Therefore, when the emulsion composition is prepared preferably under reduced pressure, foam included in the emulsion composition can be removed, and the produced porous material has only cells formed through removal of the dispersion phase. The cells are substantially spherical.

Figure 1A:
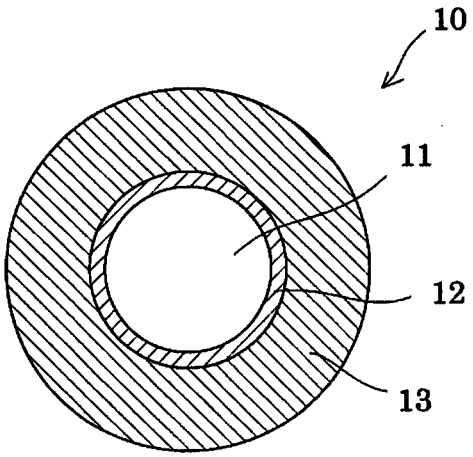
FIG. 1A is a transverse cross-section of a fixing pressure roller according to an embodiment of the invention.
Figure 1B:
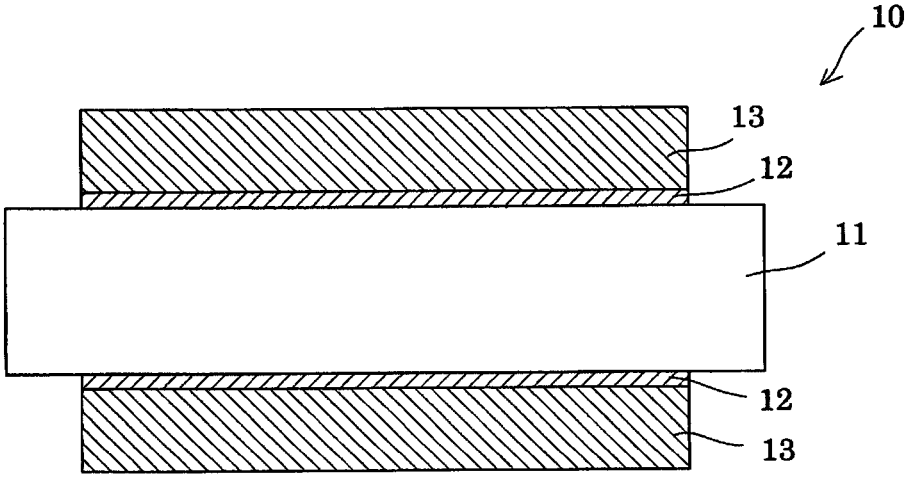
FIG. 1B is a longitudinal cross-section of the same fixing pressure roller.

FIG. 1A is a transverse cross-section of a fixing pressure roller according to an embodiment of the invention, and FIG. 1B is a longitudinal cross-section of the same fixing pressure roller. As shown in FIGS. 1A and 1B, a fixing pressure roller 10—an embodiment of the present invention—has a metallic core 11, a rubber layer 12 provided around the core 11, and an elastic layer 13 which is formed of the aforementioned porous elastomer and which is provided around the rubber layer 12.

Figure 2:
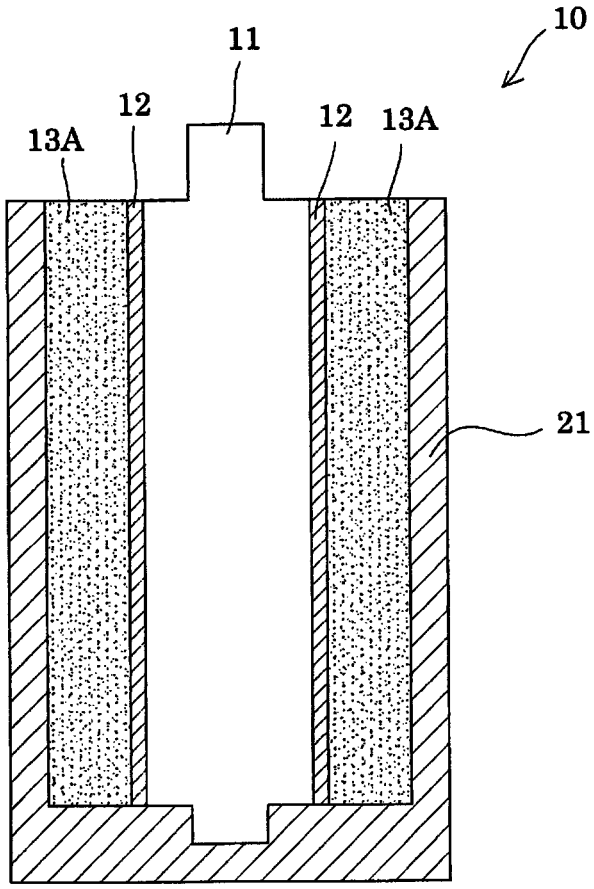
FIG. 2 is a sketch showing a step of producing a fixing pressure roller according to an embodiment of the invention.

The elastic layer 13 is formed as shown in FIG. 2. Specifically, the core 11 provided with the rubber layer 12 is placed in a metal mold 21; a porous elastomer precursor (i.e., an emulsion composition) 13A is applied so as to surround the rubber layer 12; the precursor is heated to cure without vaporizing the ingredients of the emulsion composition; and curing is completed by further heating with removal of liquid. Thus, the elastic layer 13 suitably and tightly bonded to the rubber layer 12 is formed.

The rubber layer 12 is a non-foamed rubber layer and serves as an adhesive for bonding to the elastic layer 13. Therefore, the rubber layer 12 is preferably formed of the same rubber material as the material of the porous elastomer, and the rubber material preferably serves as an adhesive. Thus, when the porous elastomer is formed of a silicone rubber, a liquid silicone rubber or an adhesive based on silicone rubber is preferably employed. Needless to say, the rubber layer 12 and the elastic layer 13 may be formed from two materials different from each other.

The rubber layer 12 preferably has a thickness as small as possible. The thickness is 1.0 mm or less, preferably 0.5 mm or less. The rubber layer 12 is required to have such a thickness that any effect of the core 11 serving as an underlayer (particularly in the case of a metallic core 11) can be completely suppressed. From this viewpoint, the thickness is preferably 0.001 mm or more, preferably 0.005 mm or more.

The ratio (T1/T2), wherein T1 represents the thickness of the rubber layer 12, and T2 represents the thickness of the elastic layer 13, is preferably 0.0001 to 0.25, more preferably 0.002 to 0.15. When the ratio satisfies the above conditions, the rubber layer 12 suppresses the effect(s) of polar groups or the like present on the surface of the core 11 during formation of the elastic layer 13 formed of a porous elastomer from a precursor, whereby the rubber layer 12 is present in a stable state during transformation of the emulsion of the emulsion composition serving as the precursor into the porous elastomer. In this case, the cells present in a portion of the elastic layer 13 in the vicinity of the rubber layer 12 and those present on the elastic layer 13 have the same shape to a maximum possible extent, after completion of thermal curing.

The conditions of the ratio (T1/T2) are derived from the following. Firstly, even when a silane coupling agent serving as an adhesive is applied onto a metal core so as to attain a coating thickness of 1 μm to 10 μm, the metal surface cannot be covered completely, and the structure of the emulsion composition in the vicinity of the core may be broken. Also, the present inventors have found that, when the coupling agent is applied so as to attain a coating thickness of about 50 to about 100 μm in order to prevent exposure of the metal surface, breakage occurs in the adhesive layer due to shear stress during compression. On the basis of this finding, the present inventors have observed the cells in a cross-section of the elastic layer 13 along the thickness direction under variation of the thickness of the rubber layer 12 and that of the elastic layer 13, to thereby determine the uniformity in shape of the cells. As a result, the ratio (T1/T2) has been found to be preferably 0.0001 to 0.25, more preferably 0.002 to 0.15.

Also preferably, the rubber layer 12 is maintained in an incompletely cure state before provision of the elastic layer 13 and is completely cured upon further heating of the elastic layer 13. In this case, the adhesion between the rubber layer 12 and the elastic layer 13 can be further enhanced. However, since the shape of the rubber layer 12 must be maintained during formation of the elastic layer 13 in a metallic mold, percent reactivity (e.g., cross-linking density or cross-linking degree) is preferably controlled to about 60% to about 80%, in the case where liquid silicone rubber is employed. Needless to say, the elastic layer 13 may be provided by use of a primer or an adhesive after complete curing of the elastic layer 13.

Meanwhile, a tube or a coating layer formed of a fluorine-containing polymer (e.g., PFA) or a silicone rubber may be provided on the surface of the elastic layer 13, in accordance with needs. In the case where a tube is provided, the tube may be disposed to cover the elastic layer 13. Alternatively, the elastic layer 13 may be formed between the rubber layer 12 and the tube, the individual components being placed in the metallic mold 21, through the aforementioned production step.

Next, the porous elastomer employed in the present invention and the production method therefor will be described in more detail, taking a silicone porous elastomer as an example.

Generally, silicone porous elastomer may be produced from a W/O emulsion which contains a liquid silicone rubber which forms a silicone elastomer through curing, and water or a mixture of water and an aqueous solvent (e.g., an alcohol) as a dispersion phase. In one possible production procedure, a liquid silicone rubber (preferably a low-viscosity liquid silicone rubber) and water are sufficiently stirred under reduced pressure, to thereby form an emulsion, and the emulsion is immediately heated to cure. However, alternatively, the silicone porous elastomer of the present invention may be suitably produced from a W/O emulsion under which has been produced by mixing a liquid silicone rubber which forms a silicone elastomer through curing, water, and a surface active silicone oil, under reduced pressure.

No particular limitation is imposed on the type of liquid silicone rubber, so long as it forms a silicone elastomer through thermal curing. Among such liquid silicone rubbers, a so-called addition-reaction-curable liquid silicone rubber is preferably used.

In the case where a liquid rubber material other than silicone is used, an emulsion is prepared from the liquid rubber material as a continuous phase, a solvent which causes phase separation with the continuous phase as a dispersion phase, and an optional surfactant or a surface active substance, and the emulsion composition is prepared from the thus-prepared emulsion.

As described above, the porous elastomer has substantially spherical cells. For producing the porous elastomer, the emulsion composition must be prepared under reduced pressure. As used herein, the expression "preparation of an emulsion composition under reduced pressure" refers to a process in which raw materials are mixed with stirring under reduced pressure to form an emulsion. Even when an emulsion composition is prepared and then degassed under reduced pressure, such a process cannot fully attain the object of the invention.

Commercial products of liquid silicone rubber may also be used. In one commercial product of addition-reaction-curable liquid silicone rubber, components; a polysiloxane having an unsaturated aliphatic group and a polysiloxane having active hydrogen, are provided in separated packages, and a curing catalyst required for curing these components (will be described in detail) is added to the polysiloxane having an unsaturated aliphatic group. Needless to say, these liquid silicone rubbers may be used singly or in combination of two or more species.

The aforementioned surface active silicone oil serves as a dispersion stabilizer for attaining stable dispersion of water in emulsion. In other words, the surface active silicone oil has hydrophilicity and affinity to liquid silicone rubber.

Needless to say, in the aforementioned W/O emulsion, water is dispersed as particles (droplets) forming a non-continuous phase (dispersion phase). As described in detail hereinbelow, the particle size of water droplets substantially determines the cell (foam) size of the silicone porous elastomer of the present invention.

One preferred embodiment of the aforementioned W/O emulsion contains a liquid silicone rubber (100 parts by weight), a surface active silicone oil (0.2 to 10 parts by weight), and water (10 to 250 parts by weight). The emulsion has remarkably excellent water dispersion stability. Use of such an emulsion results in production of suitable porous material in a more consistent manner. Needless to say, surface active silicone oils may be used singly or in combination of two or more species.

In the case where the emulsion composition contains a liquid rubber material other than silicone, an emulsion is prepared from the liquid rubber material as a continuous phase, a solvent which causes phase separation with the continuous phase as a dispersion phase, and an optional surfactant or a surface active substance, and the emulsion composition is prepared from the thus-prepared emulsion.

The porous elastomer may contain a variety of additives in accordance with the purpose of use. Examples of such additives include a colorant (a pigment or a dye), a conducting agent (carbon black, metallic powder, etc.), and a filler (e.g., silica).

The emulsion composition employed in the present invention may be produced through a variety of methods. In one typical production procedure, a W/O emulsion composition containing a silicone elastomer is produced by mixing a liquid silicone rubber, a surface active silicone oil, water, and an optional additive or additives under reduced pressure and sufficiently stirring the mixture. Specifically, the reduced pressure is, for example, −30 kPa or less, preferably −60 kPa or less. Instead of mixing and stirring under reduced pressure, in an alternative procedure, raw materials are degassed in advance, and the mixture is stirred in a non-gas (e.g., air)-contact state, to thereby form an emulsion.

In production of the porous elastomer from an emulsion composition, the emulsion composition is heated to cure without vaporizing the ingredients of the composition, in the presence of an optional curing catalyst, and curing is completed by further heating with removal of liquid.

In production of silicone porous elastomer, an emulsion composition is heated (i.e., primary heating). In the primary heating, the emulsion composition is preferably heated at 130° C. or lower for thermally curing the liquid silicone rubber without vaporizing water contained in the emulsion. The primary heating is generally conducted at 80° C. or higher, for about 5 minutes to about 60 minutes. Through the primary heating, the liquid silicone rubber is cured, whereby water particles in the emulsion are confined in the cured silicone rubber in the same dispersion state. The thus-cured silicone rubber is further cured to such an extent that the cured product is not broken due to expansion of water vaporized during further heating (i.e., secondary heating described in detail hereinbelow). The secondary heating is conducted to remove water contained in the cured silicone rubber in which water particles have been confined. The secondary heating is preferably conducted at 70° C. to 300° C. When the heating temperature is lower than 70° C., removal of water requires a long period of time, whereas when the heating temperature is in excess of 300° C., the cured silicone rubber may be degraded. When the secondary heating is performed at 70° C. to 300° C., water can be removed via vaporization in 1 hour to 24 hours. In addition to removal of water through vaporization by the heating, curing of the silicone rubber is completed. After removal of water via vaporization, cells of almost the same size as the water particles are provided in the cured silicone rubber material (i.e., silicone elastomer).

As described above, the porous elastomer employed in the present invention can be produced from the emulsion composition without accompanying foaming, such as forming with a chemical foaming agent. The dispersion phase (e.g., water particles) of the emulsion composition is confined in the cured elastomer formed through the primary heating, and vaporized during the secondary heating.

Several modes of employment of the above-described fixing pressure roller 10 will be given.

Figure 3A:
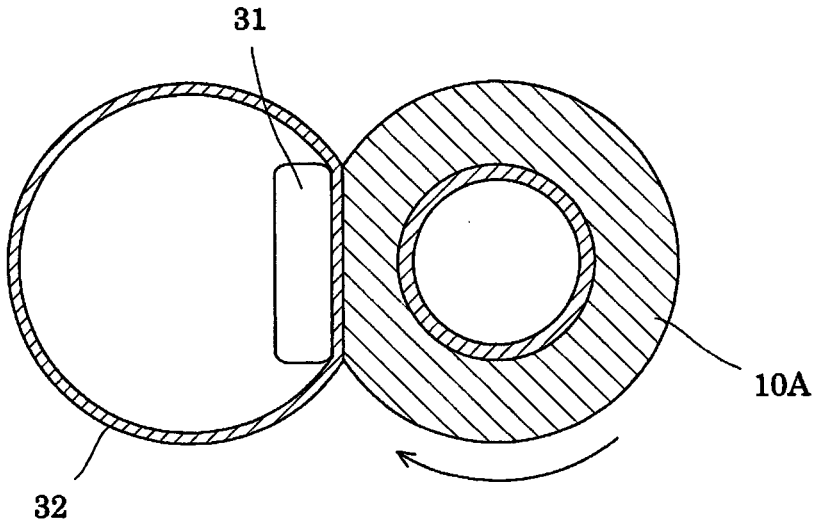
FIG. 3A is a sketch showing a mode of employment of the fixing pressure roller according to the invention.

FIG. 3A is a sketch showing a mode of employment of the fixing pressure roller according to the invention. A pressure roller 10A is employed while it is pressed by a fixing belt 32 holding a pressure member 31 including a heater therein.

Figure 3B:
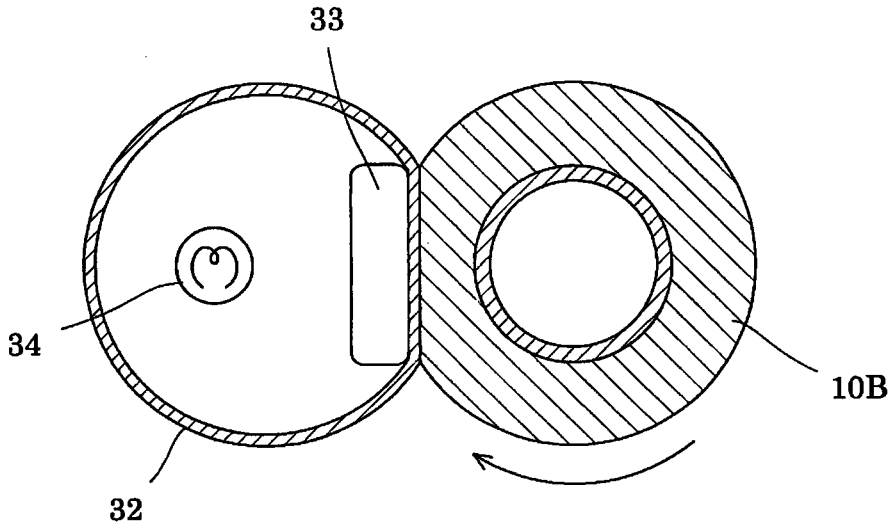
FIG. 3B is a sketch showing another of employment of the fixing pressure roller according to the invention.

FIG. 3B is a sketch showing another mode of employment of the fixing pressure roller according to the invention. A pressure roller 10B is employed while it is pressed by a fixing belt 32 holding a pressure member 33 and a heater 34.

Figure 4A:
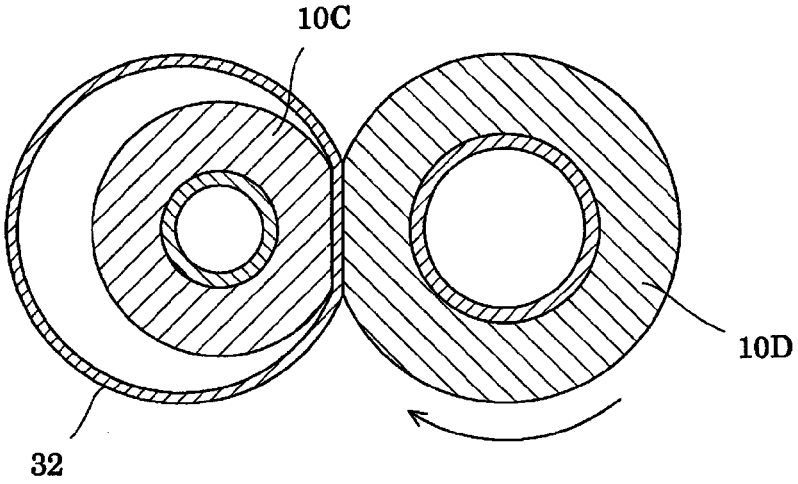
FIG. 4A is a sketch showing another of employment of the fixing pressure roller according to the invention.

FIG. 4A is a sketch showing another mode of employment of the fixing pressure roller according to the invention. A fixing roller 10C including a heater therein is placed inside the fixing belt 32. The fixing roller 10C is a possible embodiment of the fixing pressure roller of the present invention. Alternatively, the fixing pressure roller of the present invention may be employed as a pressure roller 10D which is pressed against the fixing roller 10C by the mediation of the fixing belt 32.

Figure 4B:
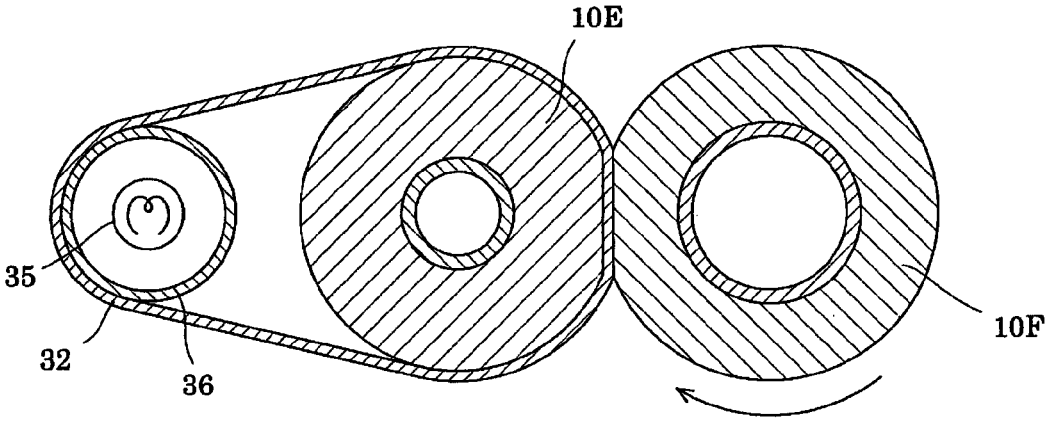
FIG. 4B is a sketch showing another of employment of the fixing pressure roller according to the invention.

FIG. 4B is a sketch showing another mode of employment of the fixing pressure roller according to the invention. A pressure roller 10F is pressed against an inner roller 10E by the mediation of the fixing belt 32 inside which the inner roller 10E and a halogen heater 36 including a heater 35 therein are disposed. Alternatively, the fixing pressure roller of the present invention may be employed as the inner roller 10E or the pressure roller 10F.

Figure 5:
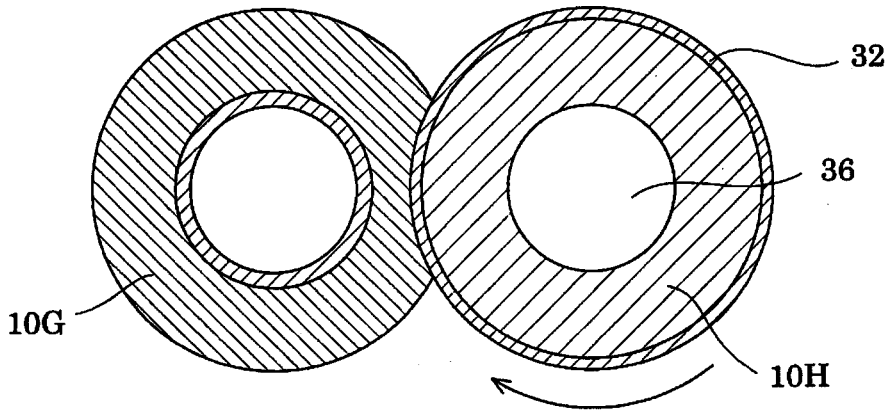
FIG. 5 is a sketch showing another of employment of the fixing pressure roller according to the invention.

FIG. 5 is a sketch showing another mode of employment of the fixing pressure roller according to the invention. A fixing roller 10H including a halogen heater 36 therein is disposed so as to face opposite a pressure roller 10G. Alternatively, the fixing pressure roller of the present invention may be employed as the pressure roller 10G or the fixing roller 10H.

EXAMPLES

Preparation of Emulsion Composition

To a reduced-pressure stirring apparatus (reduced pressure: −60 kPa), there were added a liquid silicone rubber (100 parts by weight), a filler (5 parts by weight), and a surface active silicone oil (5 parts by weight). The mixture was stirred at a reduced pressure of −60 kPa. To the mixture, water (140 parts by weight) was gradually added with stirring, to thereby prepare a W/O emulsion composition.

Example 1

To the surface of a metallic core shaft having a diameter of 20 mm, a liquid silicone rubber (methylvinylsilicone rubber) was applied to a coating thickness of 0.005 mm, and the liquid silicone rubber was cured to such an extent that the shape of the coating was maintained. The semi-cured product was placed in the center of a metal mold, and the aforementioned emulsion was poured into the mold. The contents of the mold were was heated at 130° C. (indicated) for 40 minutes (i.e., primary heating). The thus-obtained molded product (i.e., porous material precursor) was heated in an electric furnace at 200° C. for 6 hours (i.e., secondary heating), to thereby remove water. The thus-treated product was polished, to thereby yield a roller having an outer diameter ϕ of 40 mm and a hardness (Asker C) of 20°.

Example 2

The procedure of Example 1 was repeated, except that the thickness of the rubber layer formed on the metallic core having a diameter of 20 mm was modified to 0.5 mm, to thereby yield a roller of Example 2.

Comparative Example 1

The procedure of Example 1 was repeated, except that a silane coupling agent was applied on the metallic core having a diameter of 20 mm instead of the liquid silicone rubber to a coating thickness of 0.005 mm, to thereby yield a roller of Comparative Example 1.

Comparative Example 2

The procedure of Example 1 was repeated, except that a silane coupling agent was applied on the metallic core having a diameter of 20 mm instead of the liquid silicone rubber to a coating thickness of 0.05 mm, to thereby yield a roller of Comparative Example 2.

Test Example 1

Each of the rollers of Examples 1 and 2 and Comparative Examples 1 and 2 was employed as a pressure roller. Specifically, the pressure roller was pressed against a fixing roller having an outer diameter of 40 mm inside which a halogen lamp was disposed, at a percent compression of 50% (see FIG. 5). While the fixing roller was maintained at 180° C., the rollers were rotated. The period of time to breakage of the pressure roller was measured.

As a result, the pressure rollers of Comparative Examples 1 and 2 broke after operation for 500 hours, whereas the pressure rollers of Examples 1 and 2 did not break after operation for 2,000 hours. Therefore, the pressure rollers of Examples 1 and 2 were found to have durability at least 4 times that of the pressure rollers of Comparative Examples 1 and 2.

What is claimed is:

1. A fixing pressure roller comprising:
a core;
a rubber layer which has a thickness of 1.0 mm or less and which is provided around the core; and
an elastic layer which is formed of a porous elastomer produced from an emulsion composition and which is provided around the rubber layer, the emulsion composition having a continuous phase of a liquid rubber material which forms an elastomer through curing.

2. The fixing pressure roller according to claim 1, wherein the liquid rubber material is a liquid silicone rubber.

3. The fixing pressure roller according to claim 2, wherein the emulsion composition comprises a W/O-type emulsion.

4. The fixing pressure roller according to claim 1, wherein the emulsion composition comprises a W/O-type emulsion.

5. The fixing pressure roller according to claim 1, wherein the rubber layer is formed of the same rubber material as the material of the porous elastomer.

6. The fixing pressure roller according to claim 1, wherein the rubber layer is formed of a liquid silicone rubber or an adhesive based on silicone rubber.

7. The fixing pressure roller according to claim 1, wherein when T1 represents the thickness of the rubber layer, and T2 represents a thickness of the elastic layer, a ratio T1/T2 is 0.0001 to 0.25.

8. The fixing pressure roller according to claim 1, wherein when T1 represents the thickness of the rubber layer, and T2 represents a thickness of the elastic layer, a ratio T1/T2 is 0.002 to 0.15.

9. The fixing pressure roller according to claim 1, wherein a porosity of the porous elastomer is 30% or higher, and the number of cells per unit area (1 $mm^2$) is 200 or more.

10. The fixing pressure roller according to claim 1, wherein a porosity of the porous elastomer is 30% or higher, and the number of cells per unit area (1 $mm^2$) is 1,000 or more.

11. The fixing pressure roller according to claim 1, wherein a porosity of the porous elastomer is 30% or higher, and the number of cells per unit area (1 $mm^2$) is 2,000 or more.

12. The fixing pressure roller according to claim 1, wherein a porosity of the porous elastomer is 40% or higher, and the number of cells per unit area (1 $mm^2$) is 200 or more.

13. The fixing pressure roller according to claim 1, wherein a porosity of the porous elastomer is 40% or higher, and the number of cells per unit area (1 $mm^2$) is 1,000 or more.

14. The fixing pressure roller according to claim 1, wherein a porosity of the porous elastomer is 40% or higher, and the number of cells per unit area (1 $mm^2$) is 2,000 or more.

15. The fixing pressure roller according to claim 1, wherein the thickness of the rubber layer is 0.001 mm to 1.0 mm.

16. The fixing pressure roller according to claim 1, wherein the thickness of the rubber layer is 0.005 mm to 1.0 mm.

17. The fixing pressure roller according to claim 1, wherein the thickness of the rubber layer is 0.001 mm to 0.5 mm.

18. The fixing pressure roller according to claim 1, wherein the elastic layer has substantially spherical microcells uniformly dispersed.

19. A fixing pressure roller comprising:
a core;
a rubber layer which has a thickness of 1.0 mm or less and which is provided around the core; and a cured elastic layer which is formed of a porous elastomer produced from an emulsion composition having a continuous phase, and which is provided around the rubber layer, the cured elastic layer having substantially spherical microcells uniformly dispersed, with a porosity of 30% or higher with 200 or more cells per $mm^2$.

* * * * *